United States Patent [19]

Hoyt

[11] 4,190,159

[45] Feb. 26, 1980

[54] ENCAPSULATED UNDERGROUND LIQUID STORAGE TANK

[75] Inventor: Jerry L. Hoyt, Rogers, Ark.

[73] Assignee: Mark Controls Corporation, Evanston, Ill.

[21] Appl. No.: 957,819

[22] Filed: Nov. 6, 1978

[51] Int. Cl.[2] ..... B65D 25/18; B65D 81/02

[52] U.S. Cl. ..... 206/524; 220/444; 220/902

[58] Field of Search ..... 206/523, 524; 220/444

[56] References Cited

U.S. PATENT DOCUMENTS

| | | | |
|---|---|---|---|
| 3,400,849 | 9/1968 | Pottier . | |
| 3,641,725 | 2/1972 | Grisell | 206/524 |
| 3,848,765 | 11/1974 | Dürkop . | |
| 3,952,082 | 4/1976 | Arnaud | 206/524 |
| 4,136,141 | 1/1979 | Bauer | 220/444 |

FOREIGN PATENT DOCUMENTS

| | | | |
|---|---|---|---|
| 2707932 | 8/1978 | Fed. Rep. of Germany | 220/444 |

*Primary Examiner*—George E. Lowrance
*Attorney, Agent, or Firm*—Young & Thompson

[57] ABSTRACT

An underground liquid storage tank is encapsulated in hardened plastic foam in a shipping carton by in situ foaming. The tank has pipe fittings that extend through the foam and abut the inside of the carton. The carton is marked on the outside with indicia to show the location of the fittings beneath the material of the carton. The tank is left in the carton perpetually from the time it leaves the plant. The ultimate user never unpacks the carton but merely buries the tank, carton and all, with the side of the carton uppermost that bears the indicia. He then cuts out the carton as indicated by the indicia, which exposes the pipe fittings, connects the necessary plumbing, and then fills the hole with dirt. The plastic foam performs the unique dual function not only of protecting the tank during shipping, but also of protecting the tank underground. The carton performs the unique dual function not only of confining the foam, but also of preventing the pipe fittings from being masked by foam.

4 Claims, 2 Drawing Figures

ENCAPSULATED UNDERGROUND LIQUID STORAGE TANK

Figure 1:
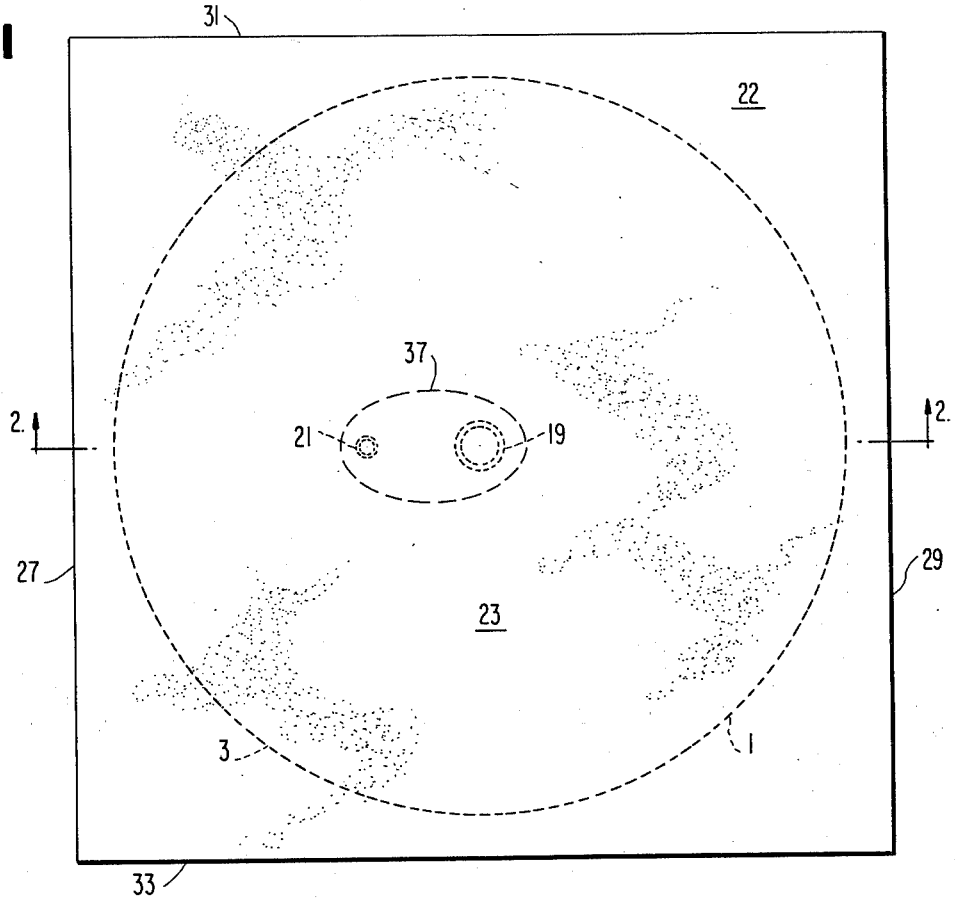

The present invention relates to underground liquid storage tanks.

It is conventional to bury water system tanks underground, for example beside a well from which water is supplied to the tank. A hole in the ground is dug to below the frost line, and the tank is placed in the hole and plumbed and then the hole is filled in. It is also conventional to coat the tank with a tar material in an effort to protect the tank from the elements and from sharp rocks which would otherwise move against the tank during normal soil movement.

However, such coating with tar is inadequate and tank life is reduced by virtue of corrosion.

It has been proposed, as in Durkop U.S. Pat. No. 3,848,765, to try to provide protection for buried liquid storage tanks that are subject to damage and underground pressure, by means of a rather complicated mechanical system. It has also been suggested, as in Pottier et al. U.S. Pat. No. 3,400,849, to use polyurethane foam for the external protection of a buried liquid container; but again, the construction of such an underground installation is complicated and difficult.

Accordingly, it is an object of the present invention to provide protection for an underground liquid storage tank, which not only will be simple and inexpensive, but which also will actually require even less work on the part of the user than if no protection were provided at all.

According to the present invention, the underground storage tank is packed in a carton with space between the tank and the carton on all sides except for the tank fittings. The tank fittings abut the wall or walls of the carton. A hardenable plastic foam, e.g. urethane, is then foamed in situ between the exterior of the tank and the interior of the carton, thereby completely filling this space. When hardened, the foam has sufficient strength but at the same time is sufficiently yielding, to protect the tank against damage during shipment.

The location of the fittings is marked by indicia on the outer side of the side walls of the carton against which these fittings abut. The ultimate user of the tank does not unpack the tank: he merely digs a hole of appropriate depth and puts the entire shipment in that hole, plastic foam, carton and all. The indicia on the carton show the proper orientation of the fittings, which will ordinarily be all on one side of the carton, which side will be the upper side when the carton is in the hole. The installer then has only to cut away that portion of the carton marked by the indicia, thereby exposing the ends of the pipe fittings. He makes the necessary pipe connections to an above-ground water conduit and possibly also an aboveground air conduit; and then the hole is filled in.

In a preferred embodiment, all the pipe fittings are on the same side of the tank and are masked by the same side wall of the carton. In that case, the ends of the pipe fittings are all disposed in a common plane, so that the same side of the carton will mask them all without deformation of the carton. In the case of a generally cylindrical water tank whose axis is upright in the buried position, that side wall of the carton will be perpendicular to the axis of the tank and the ends of the fittings will all lie in a common plane perpendicular to that axis.

The hardened plastic foam, which is conventional itself, performs a unique dual function in the present invention: not only does it serve to protect the tank during shipment, but also it serves to protect the tank against corrosion after burial.

The carton, which, apart from its indicia, may be conventional by itself, also performs a unique dual function in this invention: not only does it confine the hardening foam and serve as a shipping carton for the tank, but also at least one of its side walls serves as a mask that protects the ends of the pipe fittings from being shrouded or hidden by the foam, so that the pipe ends are exposed for easy access upon removing a marked portion of the carton wall.

Figure 2:
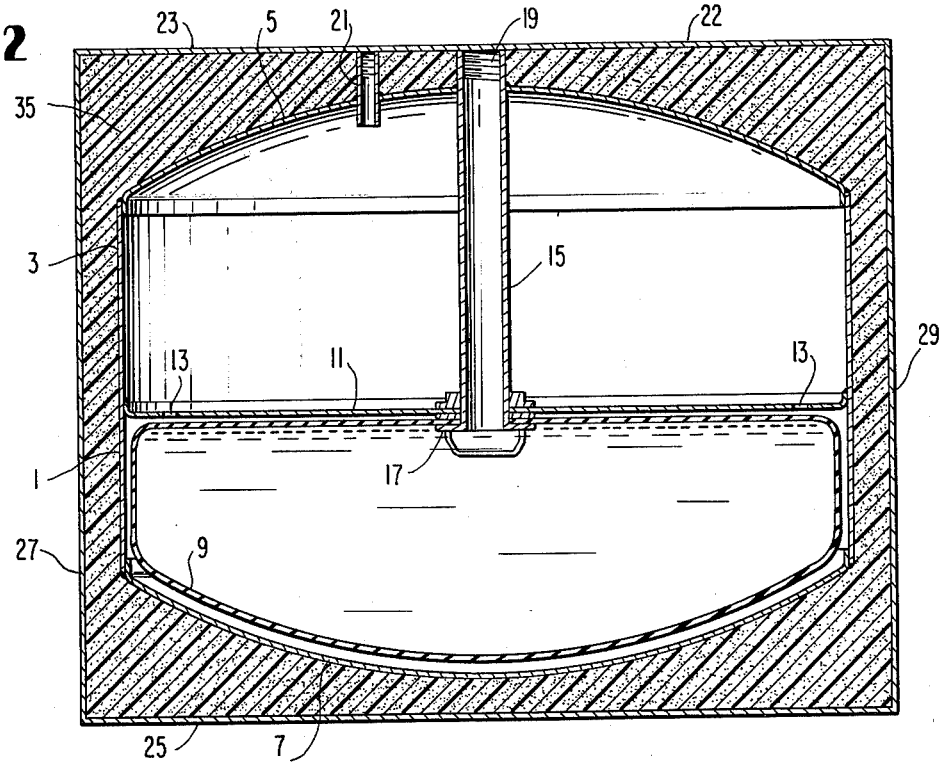

Other objects, features and advantages of the present invention will become apparent from a consideration of the following description, taken in connection with the accompanying drawing, in which:

FIG. 1 is a top plan view of the exterior of the carton containing an encapsulated liquid storage tank according to the present invention; and FIG. 2 is a crosssectional view of the encapsulated liquid storage tank with its encapsulation and carton, taken on the line 2—2 of FIG. 1.

Referring now to the drawing in greater detail, there is shown a liquid storage tank 1 of generally conventional steel construction, including a vertical cylindrical side wall 3 and generally spherically domed top and bottom walls 5 and 7, respectively. A waterproof flexible bladder 9 of rubber or the like is disposed within tank 1. A formed head 11 extends across tank 1 and limits the extension of bladder 9. Head 11 is traversed by a plurality of holes 13 for compressed air that is used to collapse bladder 9 to eject liquid therefrom through a stainless steel pipe 15. Head 11, pipe 15 and bladder 9 are appropriately interconnected by the usual fittings 17.

Pipe 15 extends beyond top wall 5 in a pipe fitting or coupling 19 which is preferably screw threaded for connection with sources or receivers of liquid. Another pipe fitting or coupling 21 traverses top wall 5 but communicates with the air space above formed head 11, for the introduction of compressed air to collapse bladder 9 and thus pump out the liquid therein through pipe 15.

Pipe fittings 19 and 21 terminate in a common horizontal plane perpendicular to the axis of cylindrical wall 3 of tank 1.

Tank 1 is disposed within a heavy cardboard container 22 which overall is conventional, of parallelepipedal shape, comprising flat rectangular top and bottom walls 23 and 25, respectively, and flat rectangular side walls 27, 29, 31 and 33. All the walls of tank 1 are spaced inwardly from the respectively adjacent walls of the container; and the space thus provided, between the outside of the tank 1 and the inside of the container, is substantially completely filled by a hardened plastic foam 35, e.g. urethane.

However, the common plane of the ends of pipe fittings 19 and 21 coincides with the plane of top wall 23 of the carton, so that the ends of fittings 19 and 21 abut the interior of top wall 23 of the carton, which accordingly shields the ends of fittings 19 and 21 from foam 35. Foam 35 thus surrounds fittings 19 and 21 laterally but not endwise. Of course, the present invention does not preclude the use of a conventional cap or protector for the screw threads of fittings 19 and 21, which are preferably internal screw threads so that it is not necessary to remove any plastic foam in order to make the appropriate pipe connections.

The outer side of top wall 23 of the carton is provided with visible indicia 37 that designate the location of pipe fittings 19 and 21 therebeneath.

To pack the tank, it is placed in the carton which is then closed; and hardenable plastic foam is foamed in situ. The composition of the foam is conventional and the in situ foaming process is conventional. It is preferred, however, that the tank be upside down in the carton during foaming, that is, with the pipe fittings 19 and 21 lowermost and resting by gravity against carton wall 23, to make sure that foam does not intrude between wall 23 and the ends of fittings 19 and 21.

Once the foam has hardened in place, then the carton can be shipped. The ultimate user receives the carton but does not unpack it. Instead, he merely digs a hole of an appropriate size to receive the carton and depth to extend below the frost line, places the carton in the hole with indicia 37 uppermost, removes that portion of wall 23 indicated by indicia 37 thereby to expose pipe fittings 19 and 21, makes his pipe connections to above-ground sources or recipients of water and possibly also compressed air, and then fills in the hole. In fact, he has to do less work than heretofore, because he does not have to preform the labor of unpacking the tank, to say nothing of the fact that he has to do noting to protect the tank against underground corrosion.

Thus, the plastic foam performs the unique dual function indicated above, of protecting the tank against damage during shipment and against corrosion when buried; while the carton performs the unique dual function not only of packing the tank during shipment but also of masking the pipe fittings against the foam so that upon subsequent removal of a portion of the carton, the pipe fittings are exposed.

In view of the foregoing disclosure, therefore, it is evident that the initially recited object of the present invention has been achieved.

Although the present invention has been described and illustrated in connection with preferred embodiments, it is to be understood that modifications and variations may be resorted to without departing from the spirit of the invention as those skilled in this art will readily understand. Such modifications and variations are considered to be within the purview and scope of the present invention as defined by the appended claims.

What is claimed is:

1. A liquid storage tank in a carton, the tank being spaced from the side walls of the carton on all sides, hardened plastic foam filling the space between the exterior of the tank and the interior of the carton, and at least one pipe fitting communicating with the interior of the tank and extending beyond the tank through the foam and endwise abutting the inner side of at least one wall of the carton.

2. A tank as claimed in claim 1, there being a plurality of said fittings abutting the same said wall of the carton.

3. A tank as claimed in claim 2, the tank being substantially cylindrical and the outer ends of said fittings being disposed in a common plane perpendicular to the axis of the cylindrical tank.

4. A tank as claimed in claim 1, and indicia on the outer side of said at least one wall, said indicia marking the location of said at least one fitting.

* * * * *